US007534996B2

(12) United States Patent
Suits et al.

(10) Patent No.: US 7,534,996 B2
(45) Date of Patent: May 19, 2009

(54) VELOCITY IMAGING TANDEM MASS SPECTROMETER

(75) Inventors: Arthur Suits, Ann Arbor, MI (US); Myung Hwa Kim, Auburn Hills, MI (US); Brian D. Leskiw, Boardman, OH (US)

(73) Assignee: Wayne State University, Detroit, MI (US)

( * ) Notice: Subject to any disclaimer, the term of this patent is extended or adjusted under 35 U.S.C. 154(b) by 267 days.

(21) Appl. No.: 11/676,882

(22) Filed: Feb. 20, 2007

(65) Prior Publication Data

US 2008/0001080 A1 Jan. 3, 2008

Related U.S. Application Data

(60) Provisional application No. 60/817,757, filed on Jun. 30, 2006.

(51) Int. Cl.
*H01J 49/40* (2006.01)

(52) U.S. Cl. ..... 250/282; 250/281; 250/287

(58) Field of Classification Search ..... 250/281, 250/282, 287, 288, 292, 283
See application file for complete search history.

(56) References Cited

U.S. PATENT DOCUMENTS 2,642,535 A * 6/1953 Schroeder ..... 250/287
3,639,757 A * 2/1972 Caroll et al. ..... 250/282
5,654,544 A * 8/1997 Dresch ..... 250/287
6,521,887 B1 * 2/2003 Funsten et al. ..... 250/287
6,770,870 B2 * 8/2004 Vestal ..... 250/281
7,041,968 B2 * 5/2006 Enke ..... 250/282
7,429,728 B2 * 9/2008 Enke ..... 250/282
2002/0117616 A1 * 8/2002 Vestal ..... 250/287
2005/0116162 A1 * 6/2005 Vestal ..... 250/287
2006/0138318 A1 * 6/2006 Enke ..... 250/287

* cited by examiner

*Primary Examiner*—Nikita Wells
*Assistant Examiner*—Johnnie L Smith, II
(74) *Attorney, Agent, or Firm*—John A. Miller; Miller IP Group, PLC

(57) ABSTRACT

A mass spectrometer that employs ion velocity mapping. The mass spectrometer includes velocity mapping ion optics that focus the ions based on their velocity. The focused ions are then directed into a deflection region between two deflection plates. A pulse is applied to the deflection plates that deflect the ions in a transverse direction also according to their mass. The pulse is turned on before the first ion in an ion packet reaches the deflection region, and is turned off before the first ion exits the deflection region. The focused and deflected ions are then reflected by a reflecting device that directs the ions along separate paths to a detector. The detector provides an image of the ion paths, where the location of a spot on the image represents ions of a certain mass and the size of the spot indicates the various velocities of the ions of that mass.

20 Claims, 2 Drawing Sheets

VELOCITY IMAGING TANDEM MASS SPECTROMETER

CROSS-REFERENCE TO RELATED APPLICATION

This application claims the benefit of the filing date of Provisional Application No. 60/817,757, filed Jun. 30, 2006.

BACKGROUND OF THE INVENTION

1. Field of the Invention

This invention relates generally to a velocity imaging mass spectrometer and, more particularly, to a velocity imaging mass spectrometer that includes ion focusing optics that provides velocity map imaging and deflection plates that provide a transverse velocity component to the ions that depends on their mass.

2. Discussion of the Related Art

Mass spectrometry is revolutionizing the study of complex molecules. Advances in proteomics now hinges on the central contribution of mass spectrometric methods where metabolic disease detection relies on mass spectra of blood spots. Particular challenges to current approaches include the ability to identifying and characterize a specific complex molecule in a mixture, the need for higher sensitivity and expanded dynamic range, the need for high through-put sample processing, and the ability to incorporate a variety of secondary interactions in the mass spectrometer to develop appropriate sensitive probes for the species of interest.

Of the various types of mass spectrometers, only those utilizing magnetic sector technology have been successful in the simultaneous detection of spatially resolved ions of different masses. Imaging based simultaneous detection of ions offers unique advantages over other time or frequency domain mass spectrometers, such as time-of-flight mass spectrometers (TOFMS), ion trap mass spectrometers (ITMS), and Fourier transform ion cyclotron resonance mass spectrometers (FT-ICRMS). In a spatially dispersive mode, the duty cycle of measurements can be effectively increased because of the multiplexing advantage, shot-to-shot fluctuations are minimized, and kinetic energy and mass may be measured simultaneously.

Simultaneous multiple ion monitoring at high resolution has been achieved over the years using double focusing electrostatic energy analyzer and magnetic sector mass spectrometers. However, one disadvantage of these devices is that the detector must be located at the plane of focus at the magnet exit. Detector technology development has thus played a crucial role in efforts to adapt this multiplexing ion detection capability. More recently, various types of array detectors, such as microchannel plate detector arrays, multiple-collector detector arrays, and integrated array systems, have been successfully applied with mass spectrometry for a simultaneous detection of multiple ions of different mass-to-charge values. On the other hand, little research has concentrated on developing instrumentation that exposes spatial separation as well as simultaneously multiplexing different masses beyond the magnetic sector approaches. The latter allows very high mass resolution and sensitivity at the price of expensive equipment and complicated operation.

Tandem mass spectrometry provides a system where a particular product mass is chosen out of a sample, then submitted to some chemical or physical interaction after which two mass spectrums are recorded. Tandem mass spectrometry is inherently a multi-dimensional technique. However, all current applications for tandem mass spectrometry rely on one-dimensional data recording. Because of this, tandem mass spectrometry is inherently less efficient than other spectrometric methods because the analysis includes the selection of a major mass peak, recording a fragment mass spectrum, and then iterating. However, this process further sacrifices potential correlations between parent and daughter ions that can provide additional insight and that make comparison of different spectra awkward and inconsistent.

Velocity map imaging has recently emerged as a powerful technique for simultaneous detection of a complete product velocity distribution for ions of a given mass. Velocity map imaging has also been extended to multi-mass detection strategies.

SUMMARY OF THE INVENTION

In accordance with the teachings of the present invention, a mass spectrometer is disclosed that employs ion velocity mapping. The mass spectrometer includes velocity mapping ion optics, having annular electrodes, that focuses the ions relative to their propagation axis based on their velocity. The focused ions are then directed into a deflection region between two deflection plates. A pulse is applied to the deflection plates that deflect the ions in a transverse direction according to their mass. The pulse applied to the plates is turned on before the first ion in an ion packet reaches the deflection region, and is turned off before the first ion exits the deflection region. The focused and deflected ions are then reflected by a reflecting device that directs the ions along separate paths to a detector. The detector provides an image of the ion paths, where the location of a spot on the image represents ions of a certain mass and the size of the spot indicates the various velocities of the ions of that mass.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a velocity imaging mass spectrometer that provides spatially resolved mass dispersion using velocity map imaging is merely exemplary in nature, and is in no way intended to limit the invention or its applications or uses.

Figure 1:
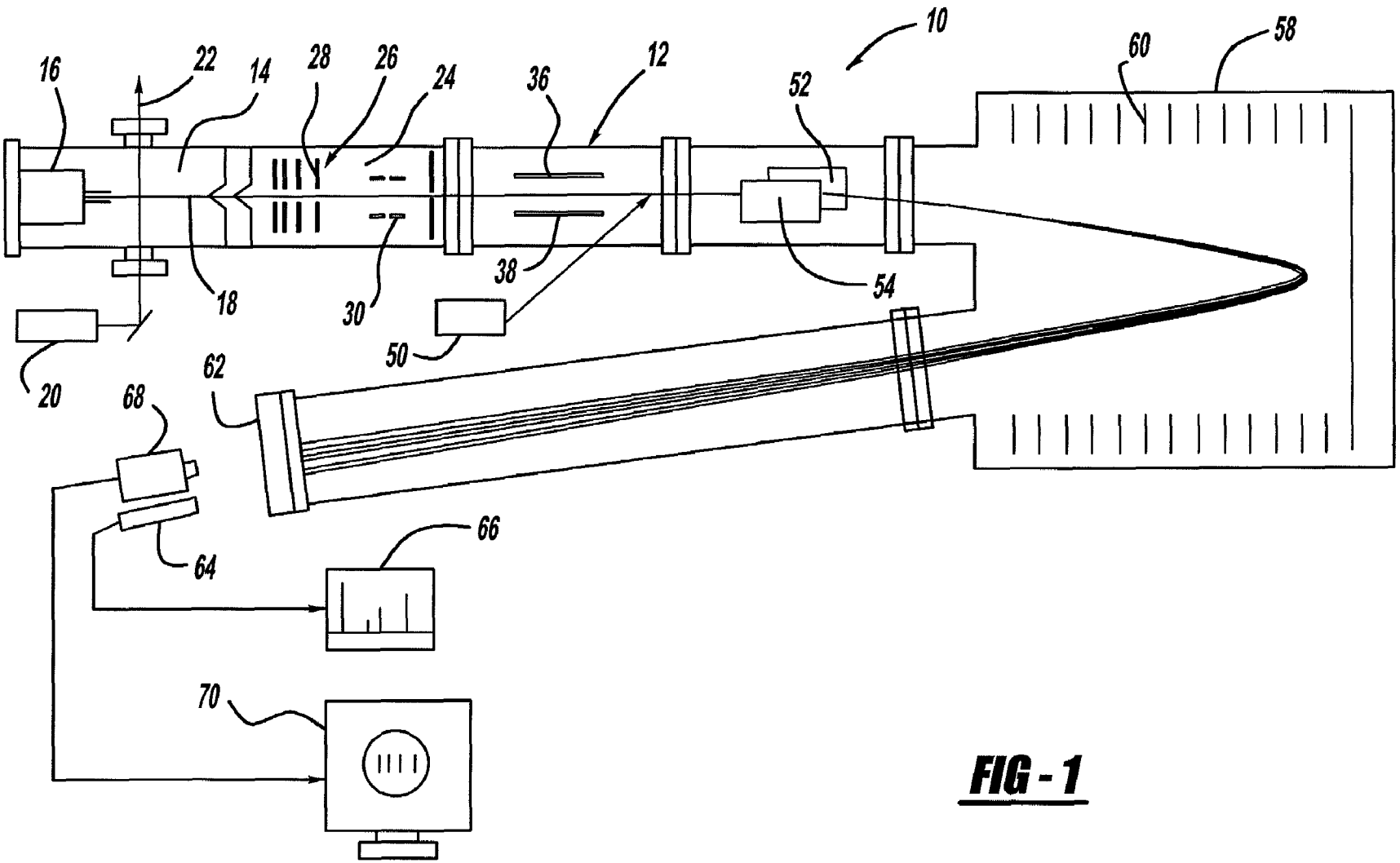
FIG. 1 is a schematic plan view of a velocity imaging tandem mass spectrometer, according to an embodiment of the present invention.

FIG. 1 is a schematic plan view of a velocity imaging tandem mass spectrometer system 10 including a tandem mass spectrometer 12. The spectrometer 12 includes a source chamber 14 having a sample source 16 that generates a pulse stream 18 of a gas sample that is being analyzed. In this embodiment, a laser 20 generates a laser beam 22 that provides resonance enhanced multi-photon ionization (REMPI) that ionizes neutral atoms in the pulse stream 18 to generate the ions. As will be appreciated by those skilled in the art, many other techniques are known in the art to provide molecule fragmentation to generate a stream of gas ions, such as matrix-assisted laser desorption/ionization (MALDI). In one embodiment, the laser beam 22 is generated by frequency doubling the output of a die laser pump of a Nd:YAG laser. The typical output power for the double die laser beam entering the chamber 14 is 1.5 mJ/pulse and accurate wavelength calibration is achieved using a wave meter. In one embodiment, the operating pressures were maintained at about $1.0\times10^{-5}$ Torr in the source chamber 14 and about $5\times10^{-18}$ Torr in the main chamber of the spectrometer 12.

The gas stream 18 enters an ion optics chamber 24 including velocity mapping ion focusing optics 26. The ion optics 26 includes a series of annular electrode lenses 28 spaced apart in a predetermined configuration to provide velocity mapping, as will be discussed in detail below. The ion optics 26 focus the ions depending on their velocity, but independent of their mass, in a direction perpendicular to their propagation axis. The focused stream of ions from the ion optics 26 is then sent through a wire-comb ion gate mass filter 30 to cluster the ions into ion packets 32. The ion packets 32 are then deflected by a pair of deflection plates 36 and 38 depending on their mass. An electric pulse is applied to the deflection plates 36 and 38 to create a pulsed electric field having a certain duration for the purposes described herein. As will be discussed in more detail below, the combination of the ion optics 26 and the deflection plates 36 and 38 provide spatially resolved mass dispersion using velocity map imaging with pulsed deflection.

Figure 2:
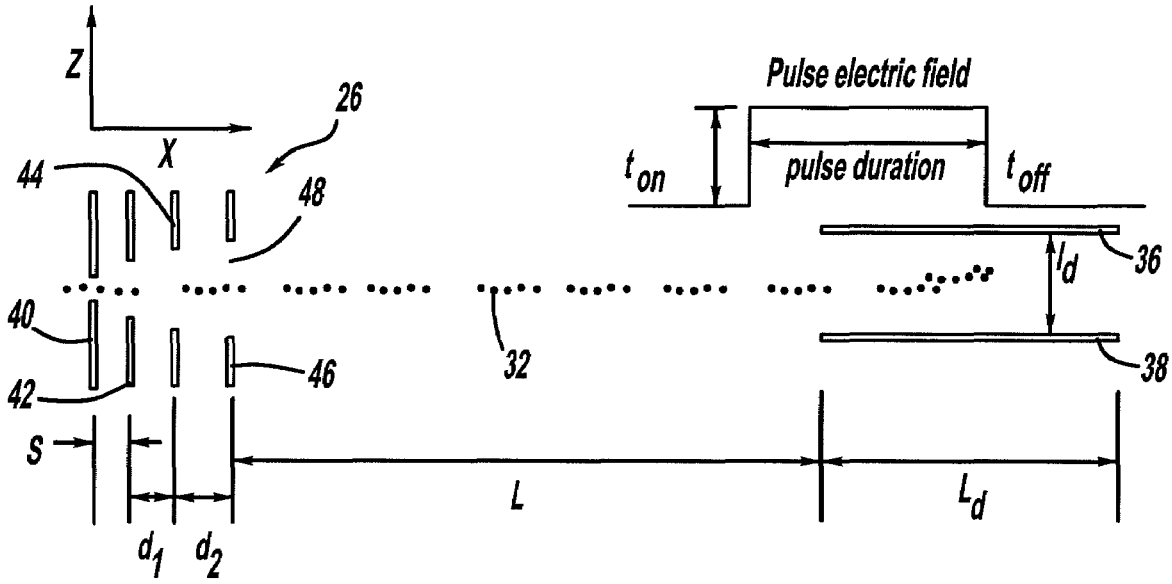
FIG. 2 is a plan view of ion optics and deflection plates used in the tandem mass spectrometer shown in FIG. 1.

FIG. 2 is a schematic plan view of the ion optics 22 and the deflection plates 36 and 38. The ion optics 26 includes four electrode lenses 40, 42, 44 and 46. The electrode lenses 42-46 are optimized to provide the velocity map imaging for a particular application by providing a desirable thickness for the lenses 42-46, a desirable spacing between the lenses 42-44 and a desirable aperture size 48 of the lenses 42-46, where the size of the apertures 48 increases from the lens 40 to the lens 46. In this example, the lens spacing is given by s, $d_1$ and $d_2$, and electric field strengths between the electrode lenses 40-46 are $E_s$, $E_{d_1}$, and $E_{d_2}$, respectively.

The focused ion packets 32 are deflected by the deflection plates 36 and 38. If the electric field applied to the deflection plates 36 and 38 was on all the time, then all of the ions in the ion packets 32 would be deflected the same, regardless of their mass. However, according to the invention, a pulsed electric field is provided by the deflection plates 36 and 38 so that the ions are deflected according to their mass. Particularly, the pulse applied to the deflection plates 36 and 38 is turned on before the first ion in the ion packet 32 reaches the deflection region between the plates 36 and 38, and is turned off before the first ion in the ion packet 32 leaves the deflection region between the plates 36 and 38, as illustrated in FIG. 2. In one embodiment, the deflection pulse is 750 ns at ±125V, and is generated 8.985 μs after the laser 20 fires. Any suitable voltage pulser can be used to provide the deflection pulse, such as the DEI, PVX-4150. The trajectory of the ion packets 32 proceed slightly off-axis and the ions are spatially separated in the direction of the applied pulse field according to their mass. Particularly, as the ions encounter the transverse pulsed field, they are forced more off-axis depending on their mass-to-charge ratio. The deflection pulse provides slightly mass-dependent spatial separation along the transverse direction. After leaving the deflection region, therefore, the ions start to separate spatially in the transverse direction according to the mass-to-charge ratio. The magnitude of the dispersion is then greatly enhanced through the field free regions and a reflectron according to the velocity map imaging.

The following is a detailed discussion of the physics behind how the ions are deflected according to their mass in this manner. When ions are born, they will have an initial energy $U_0$ and can be accelerated to have an energy U that is independent of their mass m, but dependent on the energy $U_0$, the distance s and ion charge q as:

$$U=U_0+qsE_s+qd_1E_{d_1}+qd_2E_{d_2} \tag{1}$$

The time-of-flight of the ions at the field free regions in the spectrometer 12 is given by:

$$t=t_s+t_{d_1}+t_{d_2}+t_L \tag{2}$$

Where each term in equation (2) is given by:

$$t_s=\frac{\sqrt{2m(U_0+qE_s)}}{qE_s} \tag{3}$$

$$t_d=t_{d_1}+t_{d_2}=\frac{\sqrt{2m}}{qE_{d_2}}[U^{1/2}-(U_0+qsE_s+qd_2E_{d_2})]+\frac{\sqrt{2m}}{qE_{d_2}}[U^{1/2}-(U_0+qsE_s+qd_1E_{d_1})] \tag{4}$$

$$t_L=L\sqrt{\frac{m}{2qU}} \tag{5}$$

When the leading edge of an ion packet 32 reaches some point just before the deflection plates 36 and 38, the pulsed electric field is applied by the plates 36 and 38 in a direction perpendicular to the initial ion packet propagation direction. The pulsed electric field is very short so that the electric field is turned off before any of the ions in the ion packet 32 leave the deflection region between the deflection plates 36 and 38. Under this condition, assuming simple transverse electrostatic deflection and no acceleration effects of transition fields, when the ions enter the region between the deflection plates 32 and 34, the transverse velocity $v_z$ of the ions is described as:

$$v_z=\int_t^{t_{off}}\frac{ql_dE_z}{m}dt=\frac{ql_dE_z}{m}(t_{off}-t) \tag{6}$$

Where m is the mass of the ion, $E_z$ is the transverse electric field strength, $l_d$ is the distance between the deflection plates 36 and 38, q is the charge of the ions, t is the time for the ion to reach the entrance of the region between the deflection plates 36 and 38, and $t_{off}$ is the turn-off time of the pulsed electric field. The difference in the time $t_{off}-t$ is equal to the time that the ion experiences the transverse field.

Because the time-of-flight in the field free region is proportional to the square root of the mass, the time t in equation (6) is different for different masses. By substituting equation (2) into equation (6), the transverse velocity of the ions arising from the pulsed electric field can be written in terms of the ion masses as:

$$v_z=\frac{\alpha}{m}+\frac{\beta}{\sqrt{m}} \tag{7}$$

Where α and β are constants.

The first term in equation (7) is related to the constant momentum pulse, when the range of time within the deflection region between the deflection plates 36 and 38 is independent of mass, and the second term represents the contribution of the projection of the initial time dispersion along the ion path direction in the transverse direction.

Equations (6) and (7) imply that two factors strongly influence the ultimate spatial mass resolution of the ions, the transverse velocity distribution of the ions and the spread in the deflection pulse duration of the ions. The transverse velocity resolution ($\Delta\upsilon_z/\upsilon_z$) is closely correlated with the spatial mass resolution on the ion detector (discussed below) and is primarily limited by small differences in flight times of ions entering the deflection region between the deflection plates 36 and 38 for ions of the same mass due to the initial energy distributions. The latter highly depends on the spatial distribution of the ion packets 32 in the deflection region along a traverse direction. The transverse velocity $s_z$ of the ions can be further transformed in the transverse distance of the ion on the detector, assuming that the reflectron (discussed below) only extends the total flight path under the homogeneous electric field as:

$$s_z = \int_{t_{off}}^{t_a} \upsilon_z dt = \int_{t_{off}}^{t_a} \frac{ql_d E_z}{m}(t_{off} - t)dt = \frac{ql_d E_z}{2m}(2t_{off} - t_a t_{off}^2 - t_a^2) \tag{8}$$

If the arrival time $t_a$ to the detector is simply proportional to the square root of the mass, the displacement of the ions along the transverse direction on the detector plane can be approximately described as:

$$sz \approx A + \frac{B}{m} + \frac{C}{\sqrt{m}} \tag{9}$$

Where A, B and C are constants.

In equation (9), it is apparent that different ions hitting the detector can be spatially separated according to two mass-dependent contribution terms. It should be noted that the range of different masses that can be detected simultaneously depends on the difference in length between the first field free region and the deflection plates 36 and 38, the size of the detector in the transverse axis and the mass value. The difference in length between the first field free region and the deflection plates 36 and 38 is governed by $(L-L_d)/L$.

The difference in the displacement $\Delta s_z$ that separates adjacent masses between m and m+1 is given by:

$$\Delta s_z \approx \frac{B}{m(m+1)} + \frac{C(\sqrt{m+1} - \sqrt{m})}{\sqrt{m(m+1)}} \tag{10}$$

As shown in equation (10), the mass dispersion between adjacent masses is small for higher values of masses, but is large for lower values of masses. Thus, a large mass range can be detected simultaneously for higher values of masses in a small spatial separation.

As discussed above, the combination of the ion optics 26 and the deflection plates 36 and 38 simultaneously provides both mass and velocity information for the ions being analyzed. The mass of the various ions that are detected by the detector are shown along one axis of an image in the detector, and the velocity of the ions of the same mass are shown by the size of the spot on the image.

Simultaneously providing the mass and velocity of ions in one dimension has particular application for analyzing the constituency of small molecules. However, it may be desirable to use tandem mass spectrometry to further fragment the ions to provide a two-dimensional image of the mass of other constituents in larger molecules. To provide the second dimension of masses, a second set of deflection plates are required. Returning to FIG. 1, the deflected ions from the deflection plates 36 and 38 are again fragmented by a laser 50 in a transverse direction to the deflection plates 36 and 38. The second fragmentation process can further fragment the already fragmented particles so that not only can the major peaks be identified for the constituents of a particular molecule, but also the minor peaks associated with each major peak.

The ion packets 32 are then sent to a deflection region between two deflection plates 52 and 54 that are oriented perpendicular to the deflection plates 36 and 348 and are pulsed in the same manner as the plates 36 and 38 to provide a deflection of the ions in the opposite direction based on their mass to provide the two-dimensional mass image.

The ion packets 32 then enter a reflectron 58 including electrodes 60 that redirects the ions of different mass-to-charge ratios in a well known manner. The reflected ions are directed along separate paths by the reflectron 58 according to their mass, and impinge a position sensitive ion detector 62. The detector 62 can be any detector suitable for the purposes described herein, such as the position sensitive dual MCP/P-47 phosphor detector. A sensor 64 views the detector 62 and generates a signal that can be viewed on an oscilloscope 66. A CCD camera 68 provides an image of the detector 62 that can be viewed on a monitor 70. The degree of spatial separation on the detector 62 is effectively controlled through a timing delay, and the width and magnitude of the voltage pulse applied to the reflector 58. The relative timing of the pulsed ion beam, the laser 20, the deflection plates 36, 38, 52 and 54 and the detector 62 can be controlled by a delay generator (not shown).

Figure 3:
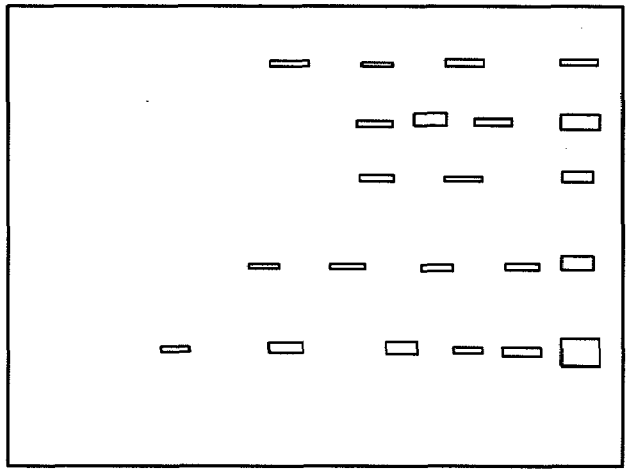
FIG. 3 is a two-dimensional image resulting from the tandem mass spectrometry of the present invention.

As discussed above, the mass spectrometer 12 is able to provide both velocity and mass measurements of the ions simultaneously. FIG. 3 is a representation of an image from the detector 62. Each spot along the bottom row of the image identifies the mass of certain ions that are reflected by the deflection plates 36 and 38, and the other rows of spots are the masses of the ions that are fragmented by the laser 50 where the columns represent those ions that are fragmented from the particular spot on the lower row. The size of the spot represents the range of velocities of the ions for that mass providing by the velocity mapping optics.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A mass spectrometer system comprising:

a source for providing a gas sample stream;

a first fragmentation device for generating a stream of ions from the gas sample stream;

ion focusing optics responsive to the stream of ions, said ion focusing optics focusing the ions depending on their velocity in a direction transverse to their propagation axis, said ion focusing optics including a series of annular electrode lenses that focus the ions, wherein the diameter of an aperture of each annular electrode lens and the spacing between the annular electrode lenses is selected for the particular gas sample;

a first pair of deflection plates receiving the stream of ions focused by the ion focusing optics therebetween, said first pair of deflection plates being responsive to an electrical pulse to generate a pulsed electric field between the first pair of deflection plates, said electrical pulse being turned on before a group of ions reaches a deflection region between the first pair of deflection plates and being turned off before the group of ions leaves the deflection region between the first pair of deflection plates so as to provide a transverse velocity component of the ions depending on the mass of the ions;

a reflecting device responsive to the stream of ions from the first pair of deflection plates, said reflecting device directing the ions in the stream along different paths depending on their mass; and a detector responsive to the ions from the reflecting device so as to provide a position sensitive image of the different ion paths.

2. The system according to claim 1 further comprising a second pair of deflection plates receiving the stream of ions from the first pair of deflection plates, said second pair of deflection plates being oriented perpendicular to the first pair of deflection plates, said second pair of deflection plates being responsive to an electrical pulse to generate a pulsed electric field between the second pair of deflection plates, said electrical pulse being turned on before a group of ions reaches a deflection region between the second pair of deflection plates and being turned off before the group of ions leaves the deflection region between the second pair of deflection plates so as to provide a transverse velocity component of the ions that depends on their mass in a direction perpendicular to the transverse velocity component provided by the first pair of deflection plates.

3. The system according to claim 2 further comprising a second fragmentation device that fragments the ions that exit the deflection region between the first pair of deflection plates, but before the ions enter the deflection region between the second pair of deflection plates.

4. The system according to claim 1 wherein the first fragmentation device is a laser.

5. The system according to claim 1 wherein the first fragmentation device is a matrix-assisted laser desorption/ionization device.

6. The system according to claim 1 further comprising an ion gate mass filter that receives the stream of ions from the ion optics, said ion gate mass filter producing separate groups of ions from the ion stream that are sent to the first pair of deflection plates.

7. The system according to claim 1 wherein the ion focusing optics includes four annular electrode lenses, and wherein the diameter of the aperture of the annular electrode lenses increases in size from an upstream annular lens to a downstream annular lens.

8. The system according to claim 1 further comprising a charge-coupled device that views the detector to provide a video image of the detector.

9. The system according to claim 1 wherein the reflecting device is a reflectron.

10. The system according to claim 1 wherein the detector provides an image of the ions and wherein a spot on the image represents ions of a particular mass and the size of a spot on the image represent a range of velocities of the ions for that mass.

11. A tandem mass spectrometer system comprising:

a source for providing a gas sample stream;

a first laser for generating a laser beam that fragments the gas sample stream to generate a stream of ions;

ion focusing optics responsive to the stream of ions, said ion focusing optics focusing the ions depending on their velocity in a direction transverse to their propagation axis, said ion focusing optics including a series of annular electrode lenses where the diameter of an aperture of each annular electrode lens and the spacing between the annular electrode lenses is selected for the particular gas sample;

a device for separating the stream of ions into ion packets;

a first pair of deflection plates receiving the ion packets, said first pair of deflection plates being responsive to an electrical pulse to generate a pulse electric field between the first pair of the deflection plates, said electrical pulse being turned on before the ion cluster reaches a deflection region between the first pair of deflection plates and being turned off before the ion packet leaves the deflection region between the first pair of deflection plates so as to provide a transverse velocity component of the ions that depend on their mass;

a second laser that fragments the ion packets that exit the deflection region between the first pair of deflection plates;

a second pair of deflection plates receiving the ion packets after they have been fragmented by the second laser, said second pair of deflection plates being oriented perpendicular to the first pair of deflection plates, said second pair of deflection plates being responsive to an electrical pulse to generate a pulsed electric field between the second pair of deflection plates, said electrical pulse being turned on before an ion packet reaches a deflection region between the second pair of deflection plates and being turned off before the ion packet leaves the deflection region between the second pair of deflection plates so as to provide a transverse velocity component of the ions that depends on their mass and the direction perpendicular to the transverse velocity component provided by the first pair of deflection plates;

a reflectron responsive to the ion packets from the second pair of deflection plates, said reflectron separating the ions into different paths depending on their mass; and a position sensitive detector responsive to the ions from the reflectron so as to provide an image of the different paths, wherein the image provided by the detector is a two-dimensional image where spots on the image in one dimension are the masses of the ions provided by the first pair of deflection plates and the spots on the image in a second direction are the masses of the ions provided by the second pair of deflection plates, and wherein the size of a spot on the image represents the range of velocities of the ions.

12. The system according to claim 11 wherein the device for separating the stream of ions into ion packets is a wire-comb ion gate mass filter.

13. The system according to claim 11 wherein the ion focusing optics includes four annular electrode lenses, and wherein the diameter of the aperture of the annular electrode lenses increases in size from an upstream annular lens to a downstream annular lens.

14. The system according to claim 11 further comprising a charge-coupled camera that views the detector to provide a video image of the detector.

15. A system for providing spatially resolved mass dispersion of ions, said system comprising:

ion focusing optics responsive to the ions, said ion focusing optics focusing the ions depending on their velocity in a direction transverse to their propagation axis, said ion focusing optics including a series of annular electrode lenses that focus the ions, wherein the diameter of an aperture of each annular electrode lens and the spacing between the annular electrode lenses is selected for the particular ions; and a pair of deflection plates receiving the ions focused by the ion focusing optics, said pair of deflection plates being responsive to an electric pulse to generate a pulsed electric field between the pair of deflection plates, said electrical pulse being turned on before a first ion in a group of ions reaches a deflection region between the pair of deflection plates and being turned off before the first ion in the group of ions leaves the deflection region between the pair of deflection plates so as to provide a transverse velocity component of the ions that depends on their mass.

16. The system according to claim 15 wherein the ion focusing optics includes four annular electrode lenses, and wherein the diameter of the aperture of the annular electrode lenses increases in size from an upstream annular lens to a downstream annular lens.

17. A system for providing spatially resolved mass dispersion of ions, said system comprising:

ion focusing optics responsive to the ions, said ion focusing optics providing velocity map imaging of the ions; and a pair of deflection plates receiving the ions from the ion focusing optics, said pair of deflection plates being responsive to an electric pulse to generate a pulsed electric field between the pair of deflection plates that deflects the ions according to their mass.

18. The system according to claim 17 wherein said electrical pulse is turned on before a first ion in a group of ions reaches a deflection region between the pair of deflection plates and being turned off before the first ion in the group of ions leaves the deflection region between the pair of deflection plates so as to provide a transverse velocity component of the ions that depends on their mass.

19. The system according to claim 17 wherein the ion focusing optics includes a plurality of annular electrode lenses, and wherein the diameter of the aperture of the annular electrode lenses increases in size from an upstream annular lens to a downstream annular lens.

20. The system according to claim 17 further comprising a detector responsive to the deflected ions from the deflection plates, said detector providing an image of the ions, wherein a spot on the image represents ions of a particular mass and the size of a spot on the image represent a range of velocities of the ions for that mass.

* * * * *

UNITED STATES PATENT AND TRADEMARK OFFICE

CERTIFICATE OF CORRECTION

PATENT NO. : 7,534,996 B2
APPLICATION NO. : 11/676882
DATED : May 19, 2009
INVENTOR(S) : Arthur Suits, Myung Hwa Kim and Brian D. Leskiw It is certified that error appears in the above-identified patent and that said Letters Patent is hereby corrected as shown below:

Column 1,
Line 9, insert the following heading and paragraph:

-- GOVERNMENT LICENSE

The U.S. Government may have a paid-up license in this invention and the right in limited circumstances to require the patent owner to license others on reasonable terms as provided for by the terms of contract Brookhaven LDRD115 awarded by the Department of Energy. --.

Column 6,
Line 18, "348" should be -- 38 --.

Signed and Sealed this

First Day of September, 2009

David J. Kappos

David J. Kappos
*Director of the United States Patent and Trademark Office*